US007132992B2

(12) United States Patent
Mori

(10) Patent No.: US 7,132,992 B2
(45) Date of Patent: Nov. 7, 2006

(54) ANTENNA APPARATUS

(75) Inventor: Kohei Mori, Kanagawa (JP)

(73) Assignee: Sony Corporation (JP)

( * ) Notice: Subject to any disclaimer, the term of this patent is extended or adjusted under 35 U.S.C. 154(b) by 9 days.

(21) Appl. No.: 11/033,400

(22) Filed: Jan. 12, 2005

(65) Prior Publication Data

US 2005/0162328 A1 Jul. 28, 2005

(30) Foreign Application Priority Data

Jan. 23, 2004 (JP) ..... P2004-016185

(51) Int. Cl.
*H01Q 13/10* (2006.01)
*H01Q 1/38* (2006.01)

(52) U.S. Cl. ..... 343/770; 343/700 MS

(58) Field of Classification Search ..... 343/700 MS, 343/702, 819, 815, 833, 834, 767, 768
See application file for complete search history.

(56) References Cited

U.S. PATENT DOCUMENTS 3,623,109 A * 11/1971 Neumann ..... 343/722
4,631,546 A * 12/1986 Dumas et al. ..... 343/833
6,320,544 B1 * 11/2001 Korisch et al. ..... 343/700 MS
6,384,797 B1 * 5/2002 Schaffner et al. ..... 343/795
6,606,057 B1 * 8/2003 Chiang et al. ..... 342/374
6,888,505 B1 * 5/2005 Tran ..... 343/702
2001/0005181 A1 * 6/2001 Desclos et al. ..... 343/817

FOREIGN PATENT DOCUMENTS

JP 11-027038 1/1999
JP 11-168318 6/1999
JP 2003-142919 5/2003

* cited by examiner

*Primary Examiner*—Don Wong
*Assistant Examiner*—Marie Antoinette Cabucos
(74) *Attorney, Agent, or Firm*—Rader, Fishman & Grauer; Ronald P. Kananen

(57) ABSTRACT

In order to have an antenna apparatus small in size and capable of switching its directivity pattern to be adaptive to multiple frequencies, the present invention provides an antenna apparatus having a first antenna element formed at an approximately center position of a planar printed circuit board and second antenna elements formed before and behind the first antenna element. It is possible to construct an antenna in which the first antenna element functions as a radiator and the second antenna elements function as a director or a reflector, respectively, by changing electrical length of the second antenna elements. The antenna becomes adaptive to multiple frequencies by feeding the second antenna elements at different phases to have the second antenna elements functioning as radiators.

3 Claims, 14 Drawing Sheets

AVERAGE GAIN (MEASURED VALUE) : dBi -6.05dBi

SLOT WIDTH OF 2mm
FR-4 BOARD (40mm SQUARE AND 1mm THICK)

AVERAGE GAIN (MEASURED VALUE) : dBi -6.80dBi

SLOT WIDTH OF 2mm
FR-4 BOARD (40mm SQUARE AND 1mm THICK)

—— Eφ

------- Eθ

SLOT WIDTH OF 2mm
FR-4 BOARD (40mm SQUARE AND 1mm THICK)

FIG. 11A
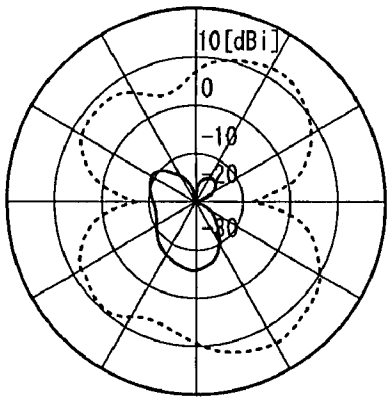
SW1, 2: SHORT-CIRCUITED
SW3, 4: OPEN-CIRCUITED
FIG. 11B
N1, 2: OPEN-CIRCUITED
N3, 4: SHORT-CIRCUITED
FIG. 11C
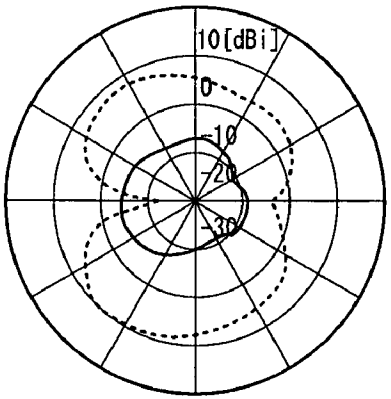
SECOND FEED UNIT 35: 90 DEGREES
THIRD FEED UNIT 36: 0 DEGREES
—— Eφ
------ Eθ
FIG. 11D
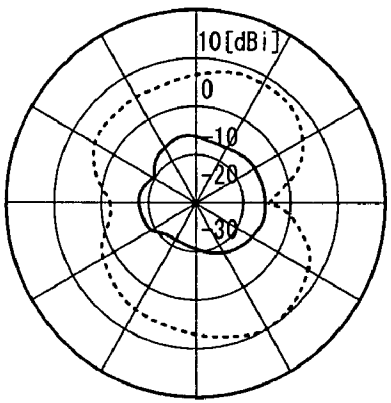
SECOND FEED UNIT 35: 0 DEGREE
THIRD FEED UNIT 36: 90 DEGREES
FREQUENCY F2
SW1 TO SW4: OPEN-CIRCUITED

ANTENNA APPARATUS

CROSS REFERENCES TO RELATED APPLICATIONS

The present document is based on Japanese Priority Document JP 2004-016185, filed in the Japanese Patent Office on Jan. 23, 2004, the entire contents of which being incorporated herein by reference.

BACKGROUND OF THE INVENTION

1. Field of the Invention

The present invention relates to an antenna apparatus capable of performing a switching of a directivity pattern.

2. Description of Related Art

Conventionally, it is known that a use of an antenna having no directivity pattern leads to a degradation of communication quality with an interference wave caused by a reflection from a building wall etc. in a multi path propagation environment in which multiple radio waves are available. Thus, an antenna apparatus capable of turning a directivity pattern in a specific direction has attracted attention.

A phased array antenna apparatus shown in FIG. 13 and an adaptive array antenna apparatus shown in FIG. 14 are known as such an antenna apparatus capable of turning a directivity pattern in a specific direction. The phased array antenna apparatus shown in FIG. 13 has N pieces of antenna elements 101-1, 101-2, . . . and 101-N. Then, an amplification of signals having been received by the N pieces of antenna elements 101-1, 101-2, . . . and 101-N is performed by amplifiers (AMP) 102-1, 102-2, . . . and 102-N. The received signals having been amplified by the amplifiers 102-1, 102-2, . . . and 102-N are outputted to a synthesizer 104 after a phase adjustment by variable phase shifters (phase shifters) 103-1, 103-2, . . . and 103-N. The synthesizer 104 performs a synthesis of the received signals from the respective variable phase shifters 103-1, 103-2, . . . and 103-N. A frequency converter (a down-converter) 105 is operated to output the resultant received signal obtained by the synthesizer 104 through a conversion into a signal of a lower frequency.

An adaptive array antenna shown in FIG. 14 has N pieces of antenna elements 111-1, 111-2, . . . and 111-N. In the adaptive array antenna of this type, the amplification of signals having been received by the N pieces of antenna elements 111-1, 111-2, . . . and 111-N is performed by amplifiers (AMP) 112-1, 112-2, . . . and 112-N at the time of a receiving operation of the above antenna. Then, the received signals having been amplified by the amplifiers 112-1, 112-2, . . . and 112-N are respectively down-converted (DC) by frequency converters 113-1, 113-2, . . . and 113-N and subsequently undergo an analog signal-to-digital signal conversion by AD/DA converters 114-1, 114-2, . . . and 114-N. Following the conversion, an output of the obtained digital signals is performed through a so-called adaptive signal processing such as weighting and synthesizing with a digital signal processing unit 115.

On the contrary, at the time of a transmitting operation, digital transmitting signals having been given a required signal processing by the digital signal processing unit 115 are converted into analog transmitting signals with the AD/DA converters 114-1, 114-2, . . . and 114-N and subsequently undergo an up-conversion (UC) with the frequency converters 113-1, 113-2, . . . and 113-N. Following the conversion, the amplification is performed by the amplifiers 112-1, 112-2, . . . and 112-N, leading to a transmission (a radiation) from the antenna elements 111-1, 111-2, . . . and 111-N.

However, the phased array antenna as shown in FIG. 13 requires that a receiving system should be configured with a plurality of variable phase shifters 103-1 to 103-N at a high frequency band. Further, the adaptive array antenna as shown in FIG. 14 requires that the adaptive signal processing should be performed using a plurality of transmitting/receiving systems. For the above reasons, either of the above antenna apparatuses calls for a complicated system and costs much, resulting in a difficult application to a consumer apparatus requiring to be produced at low cost.

By the way, a Yagi-Uda antenna widely used for a reception of television broadcasting is well known as an antenna having a directivity pattern in a specific direction. The Yagi-Uda antenna shown in FIG. 15A comprises a radiator 121 that radiates a radio wave, a director 122 having an electrical length slightly smaller than an electrical length ($2/\lambda g$, where $\lambda g$ is a guide wavelength) of the radiator 121 and a reflector 123 having an electrical length slightly larger than the electrical length of the radiator 121, wherein the director 122 and the reflector 123 are disposed before and behind the radiator 121 to ensure that the directivity as shown in FIG. 15B is obtained.

Then, a patent document 1 proposes an antenna apparatus that is configured based on the above Yagi-Uda antenna to ensure that a switching of a direction of the directivity is performed. Further, a patent document 2 proposes an antenna apparatus in which a sharing of a director is applied to attain a reduction in antenna size, with reference to an antenna apparatus that performs the switching of a feed point to ensure that a formation of multi-beams is attained. Furthermore, a patent document 3 proposes a multi-beam antenna of multi-frequency sharable type.

[Patent document 1] Japanese Patent Application Publication (KOKAI) No. Hei 11-27038

[Patent document 2] Japanese Patent Application Publication (KOKAI) No. 2003-142919

[Patent document 3] Japanese Patent Application Publication (KOKAI) No. Hei 11-168318

SUMMARY OF THE INVENTION

However, the antenna apparatus of the above patent document 1 is in the form of an array of multiple Yagi-Uda antennas, and thus requires more than one director and more than one reflector, resulting in a disadvantage of being difficult of a downsizing. Further, the antenna apparatus of the above patent document 1 is supposed to be of a structure in which a monopole antenna is projecting in a vertical direction of a ground plate, also resulting in a difficulty in attaining a reduction in thickness. Alternatively, it is also suggested that a dipole antenna should be used in place of the monopole antenna, for instance, to form the antenna on a printed circuit board, in which case, however, the ground plate fails to be disposed in the vicinity of the antenna, resulting in a difficult packaging of a selector switch etc. Further, the monopole antenna, even if formed with a dielectric substance, has little effect of shortening a wavelength, resulting in a disadvantage of being difficult to downsize.

The antenna apparatus of the above patent document 2 applies the sharing of the director to reduce an antenna size, so that there is a limitation to the downsizing. Further, the antenna apparatus of the above configuration needs a selector switch between transmitting and receiving systems for each beam direction to attain the formation of multi-beams, resulting in a disadvantage in that the selector switch leads to a degradation of efficiency as the antenna. Furthermore, the antenna apparatus of the above configuration is basically supposed to have one transmitting/receiving system, so that a one-to-multiple switching is required for the selector switch, resulting in a disadvantage of being very difficult of a manufacturing adaptive to an available frequency band of a radio communication.

Moreover, the antenna apparatus of each of the above patent documents 1 and 2 has been considered to be incapable of using a transmitting/receiving frequency at more than one frequency. On the contrary, the multi-frequency sharable multi-beam antenna of the above patent document 3 is supposed to be available at more than one frequency, in which case, however, the antenna of this type is merely in the form of the array of antennas to individual frequencies, resulting in a disadvantage of being difficult to downsize.

Thus, the present invention has been undertaken in view of the above problems, and is intended to realize that an antenna apparatus being small in size and capable of performing the switching of a directivity pattern is adaptive to multiple frequencies.

To attain the above object, an antenna apparatus according to the present invention comprises a first antenna element having a prescribed electrical length, first feed means capable of performing a feed to the first antenna element, second antenna elements respectively having an electrical length larger than the electrical length of the first antenna element and disposed at the opposite sides of the first antenna element, second feed means capable of performing, at respectively different phases, the feed to the second antenna elements disposed at the opposite sides of the first antenna element, and changing means of changing each electrical length of the second antenna elements.

According to the above configuration, a first antenna circuit may be formed by performing the feed from the first feed means to the first antenna element, for instance, and by changing, by the changing means, the electrical length of either of the second antenna elements disposed at the opposite sides of the first antenna element. Further, a second antenna circuit may be formed by performing the feed at the respectively different phases from the second feed means to the second antenna elements disposed at the opposite sides of the first antenna element.

Thus, according to the present invention, a formation of more than one antenna circuit ensures that a multi-frequency antenna being adaptive to more than one frequency and besides, capable of controlling the directivity pattern is realizable. Further, in this case, the second antenna elements may be used in common as the first antenna circuit and the second antenna circuit, so that the downsizing of the antenna apparatus is attainable.

BRIEF DESCRIPTION OF THE DRAWINGS

FIG. 11, consisting of FIG. 11A, FIG. 11B, FIG. 11C, FIG. 11D, is a view showing the directivity patterns of the multi-frequency antenna of the embodiment of the present invention.

DESCRIPTION OF PREFERRED EMBODIMENTS

A description on a basic structure of an antenna apparatus specified as an embodiment of the present invention is hereinafter given. Incidentally, the embodiment of the present invention is described by taking a case of an antenna apparatus suitable to a wireless LAN (Local Area Network) in which a radio wave of 5.2 GHz band, for instance, is available.

Figure 1A:
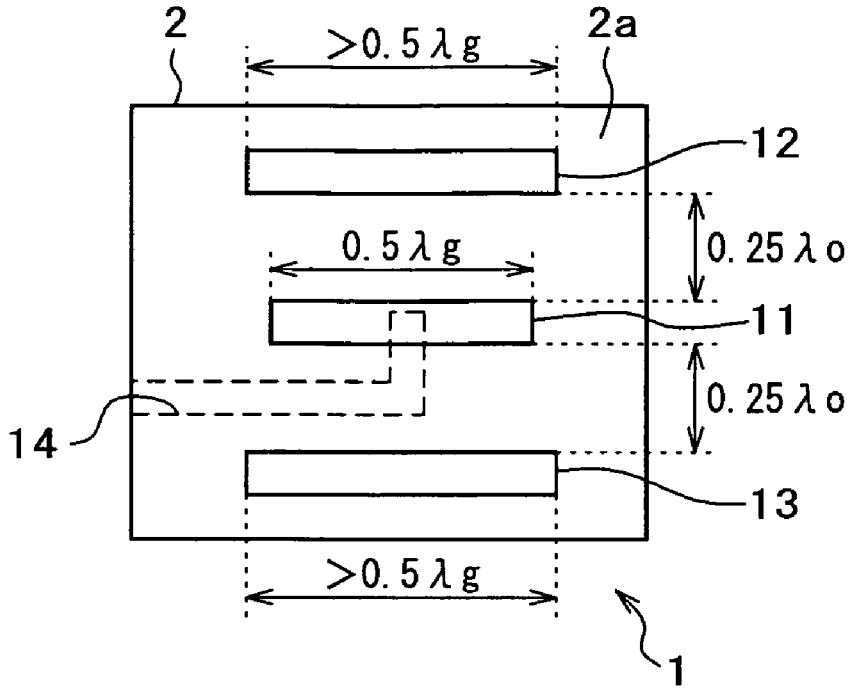
FIG. 1, consisting of FIG. 1A and FIG. 1B, is a view for illustrating a configuration of a Yagi slot antenna specified as an embodiment of the present invention.

FIG. 1A is a view showing a configuration of a slot antenna that forms the basis of the antenna apparatus specified as the embodiment of the present invention. A slot antenna 1 shown in FIG. 1A has, at an approximately center position of a planar printed circuit board 2, a driven element 11 given a feed, and before and behind the driven element 11, parasitic elements 12 and 13 respectively given no feed. Then, the slot antenna 1 having the above configuration is supposed to be capable of radiating radio waves from the driven element 11.

The driven element 11 is in the form of a slot (a slit) provided in a conductor (a ground plate) 2*a* formed at one surface side of the planar printed circuit board 2, for instance. The driven element 11 is given the feed with a micro-strip transmission line 14 formed at the other surface side of the planar printed circuit board 2. Each of the parasitic elements 12 and 13 is also in the form of a slot provided in the conductor 2*a* of the planar printed circuit board 2, for instance.

In this case, a slot length (an electrical length) of the driven element 11 is specified as a length equivalent to a ½ wavelength (0.5 λg) of a transmitting/receiving frequency required for the slot antenna 1 to perform a transmission and a reception.

Each slot length (the electrical length) of the parasitic elements 12 and 13 is supposed to be larger than the slot length (0.5 λg) of the driven element 11. Further, the driven element 11 and the parasitic elements 12 and 13 are spaced at intervals of about ¼ wavelength (0.25 λo, where λo represents a free space wavelength), respectively.

Figure 1B:
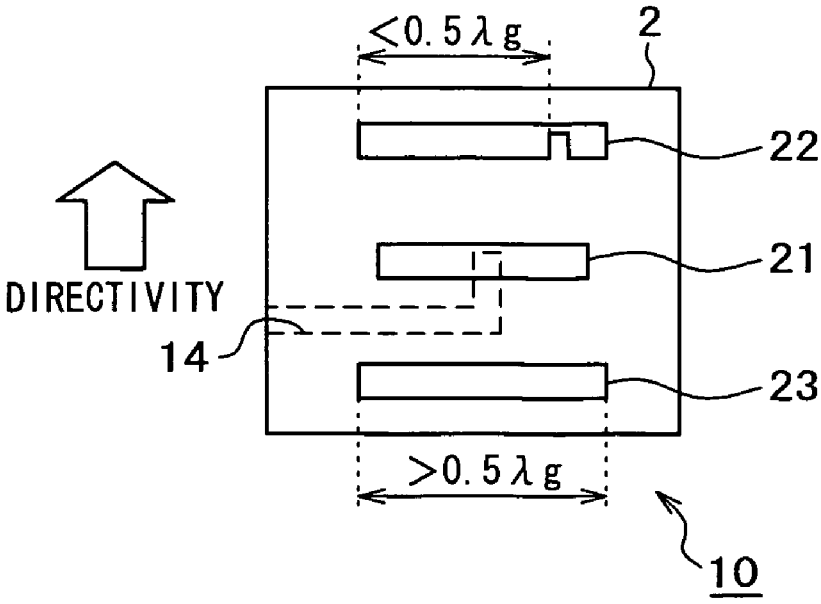

Then, the antenna apparatus of the embodiment of the present invention ensures that the antenna apparatus is configured using the slot antenna 1 having the above structure. FIG. 1B is a view showing the configuration of a Yagi slot antenna available as the antenna apparatus of the embodiment of the present invention. A Yagi slot antenna 10 shown in FIG. 1B sets the driven element 11 of the slot antenna 1 shown in FIG. 1A to function as a radiator 21 as it is. As to the parasitic element 12 similarly shown in FIG. 1A, a function as a director 22 is provided by means of making the electrical length thereof equal to or slightly smaller than the electrical length (the ½ wavelength) of the radiator 21. As to the parasitic element 13, a function as a reflector 23 is provided by means of taking advantage of the electrical length larger than the electrical length of the driven element 11 as it is. Thus, a directivity of the Yagi slot antenna 10 of the embodiment of the present invention as shown in FIG. 1B is directed as shown by an arrow, that is, in a direction from the radiator 21 toward the director 22.

Incidentally, in the present specification, the electrical length required to set the parasitic elements 12 and 13 to function as the director 22 is hereinafter referred to as a director length. Further, the electrical length required to set the parasitic elements 12 and 13 to function as the reflector 23 is referred to as a reflector length. Further, in the slot antenna, there is a change of a resonant frequency also depending on a dielectric constant of a board material of the planar printed circuit board 2, so that each electrical length of the driven element 11 and the parasitic element 12 is determined in consideration of the dielectric constant etc. of the planar printed circuit board 2.

Figure 2A:
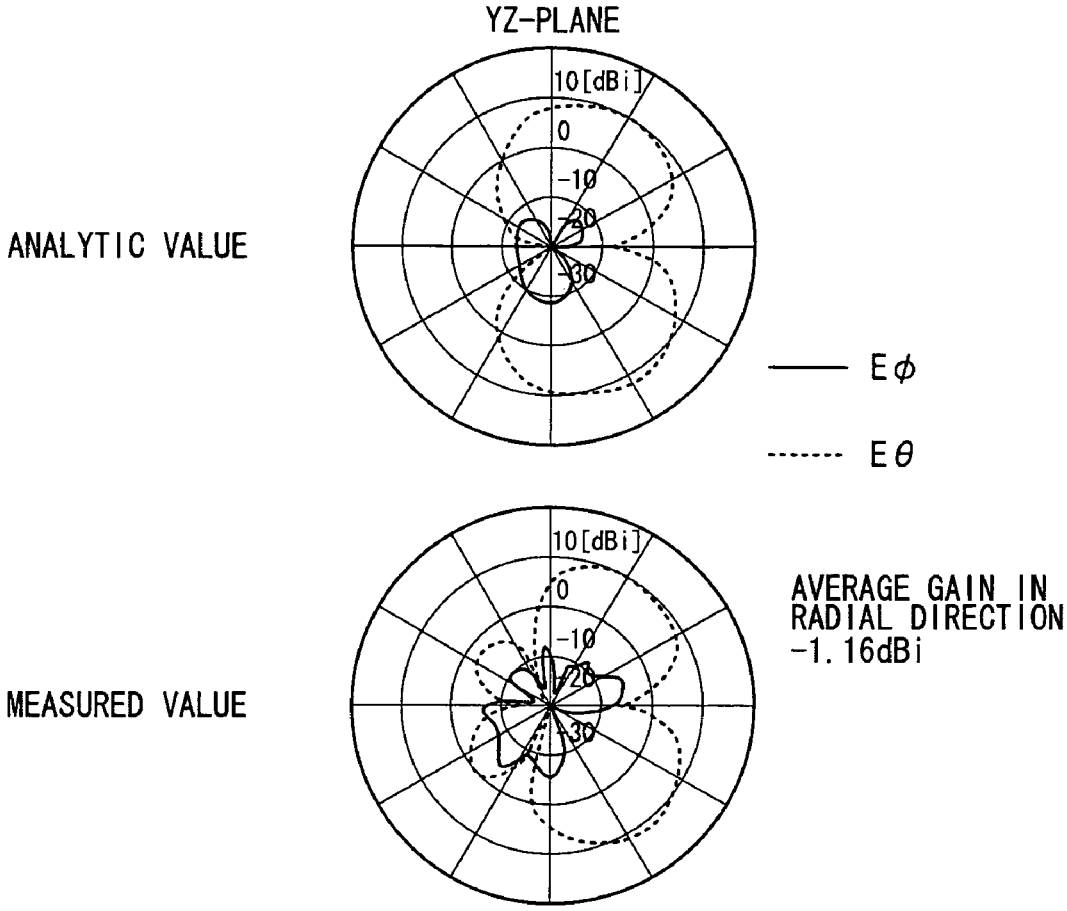
FIG. 2, consisting of FIG. 2A and FIG. 2B, is a view showing directivity patterns of the Yagi slot antenna of the embodiment of the present invention.
Figure 2B:
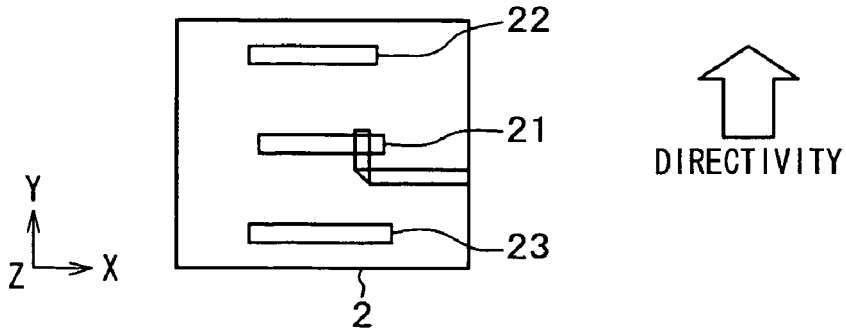

FIGS. 2 and 3 are views showing directivity patterns of the Yagi slot antenna 10 shown in FIG. 1B. Incidentally, each of the directivity patterns shown in FIGS. 2 and 3 is assumed to be one obtained when the planar printed circuit board 2 has thereon the director 22, the radiator 21 and the reflector 23 that are 2 mm in slot width and respectively 18 mm, 17 mm and 20.5 mm in slot length. Further, a FR-4 board formed with a glass epoxy resin having a planar size of 40 mm×40 mm, a thickness of 1 mm and a dielectric constant of 4.2 as a material is used for the planar printed circuit board 2. Further, the directivity pattern shown in FIG. 2B is assumed to be one obtained when a length direction of the slot, a width direction of the slot and a thickness direction of the printed circuit board 2 are specified as a X-direction, a Y-direction and a Z-direction, respectively.

Analytic values and measured values of the directivity patterns of a horizontal polarized wave Eϕ and a vertical polarized wave Eθ in a YZ-plane of the above Yagi slot antenna 10 are given as shown in FIG. 2A, wherein it may be appreciated that the direction of the directivity undergoes a control by the director 22 and the reflector 23. Incidentally, the measured value of an average gain in this case is assumed to be −6.05 dBi, and an average gain in a radial direction is assumed to be −1.16 dBi.

Figure 3A:
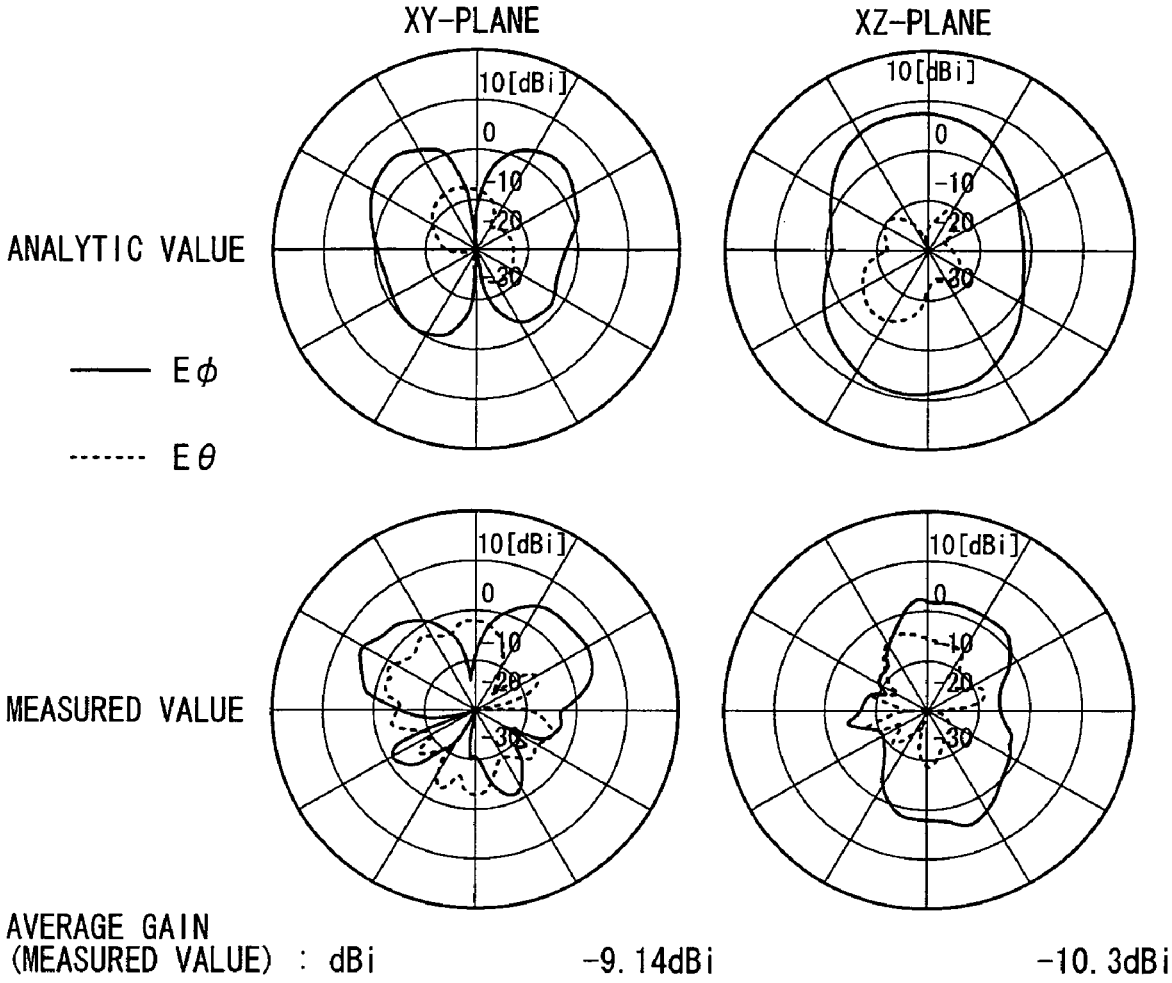
FIG. 3, consisting of FIG. 3A and FIG. 3B, is a view showing the directivity patterns of the Yagi slot antenna of the embodiment of the present invention.

For reference, the analytic values and the measured values of the directivity patterns of the horizontal polarized wave Eϕ and the vertical polarized wave Eθ in an XY-plane and an XZ-plane of the Yagi slot antenna 10 are given as shown in FIG. 3A, and the respective average gains (the measured values) are assumed to be −9.14 dBi and −10.3 dBi.

Figure 3B:
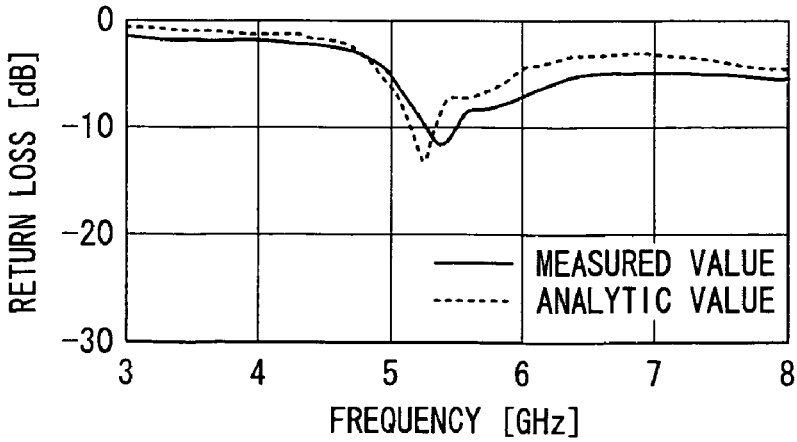

FIG. 3B is a view showing an input feature of the Yagi slot antenna 10 shown in FIG. 1B, wherein it may be appreciated from the input feature in FIG. 3B that the Yagi slot antenna 10 causes a resonance with the length of the radiator 21 assumed to be about a ½ wavelength of the guide wavelength.

Figure 4A:
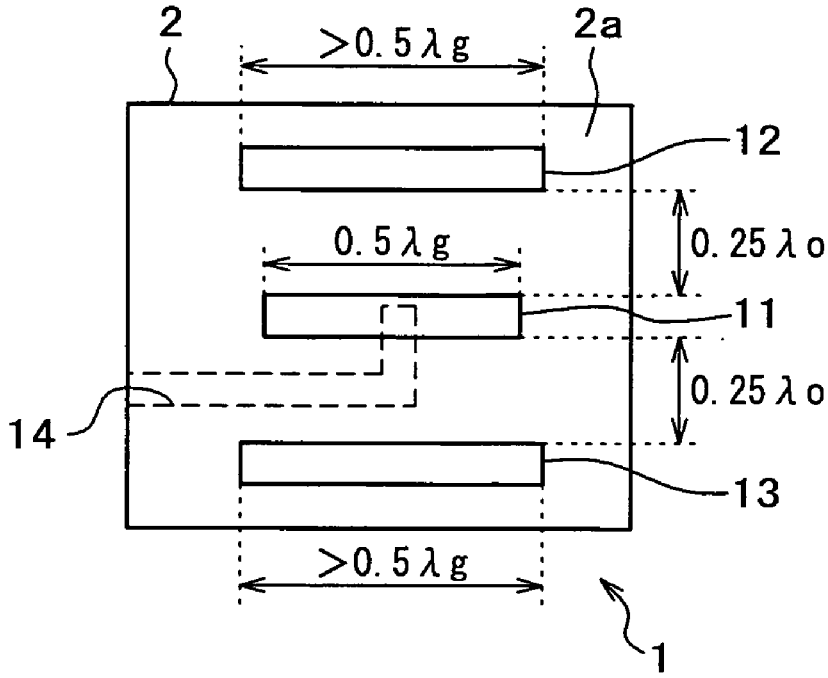
FIG. 4, consisting of FIG. 4A and FIG. 4B, is a view illustrating a different configuration of the Yagi slot antenna of the embodiment of the present invention.

The Yagi slot antenna 10 of the embodiment of the present invention ensures that an antenna apparatus having different directions of the directivity is configured by taking advantage of the above slot antenna 1. FIG. 4A is a view showing the slot antenna 1 that forms the basis of the Yagi slot antenna 10 specified as the embodiment of the present invention, wherein the above slot antenna 1 is supposed to have the same configuration as the slot antenna in FIG. 1A.

Figure 4B:
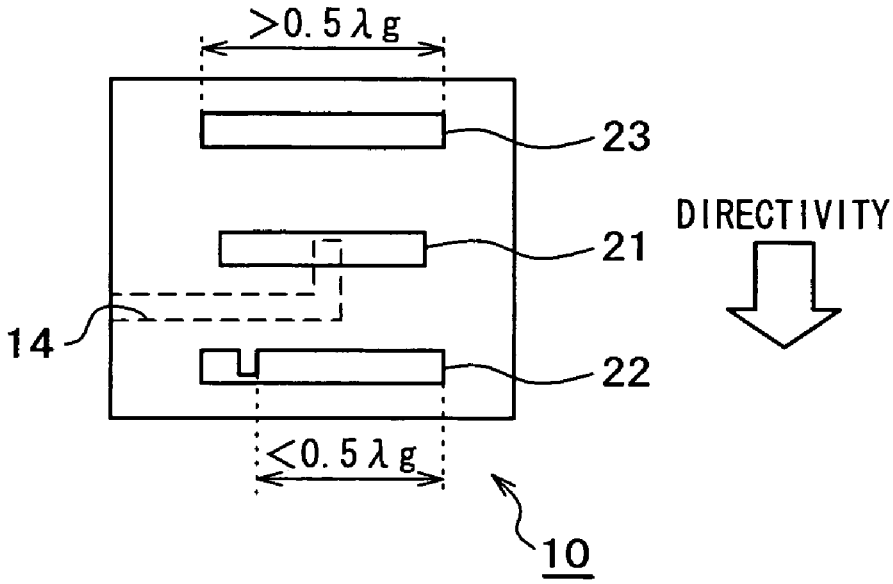

The Yagi slot antenna 10 in this case sets the driven element 11 shown in FIG. 4A to function as the radiator 21 as it is, as shown in FIG. 4B. In addition to the above, the function as the reflector 23 is provided by means of setting the electrical length of the parasitic element 12 at the reflector length, while the function as the director 22 is provided by means of setting the electrical length of the parasitic element 13 at the director length.

In other words, the Yagi slot antenna 10 shown in FIG. 4B is supposed to set the parasitic element 12 having been set to function as the director 22 in FIG. 1B to function as the reflector 23, and the parasitic element 13 having been set to function as the reflector 23 to function as the director 22. Thus, the directivity of the Yagi slot antenna 10 of the embodiment of the present invention shown in FIG. 4B is directed as shown by an arrow in FIG. 4B, resulting in the opposite direction to that shown in FIG. 1B.

FIGS. 5 and 6 are views showing the directivity patterns of the Yagi slot antenna 10 shown in FIG. 4B.

Figure 5A:
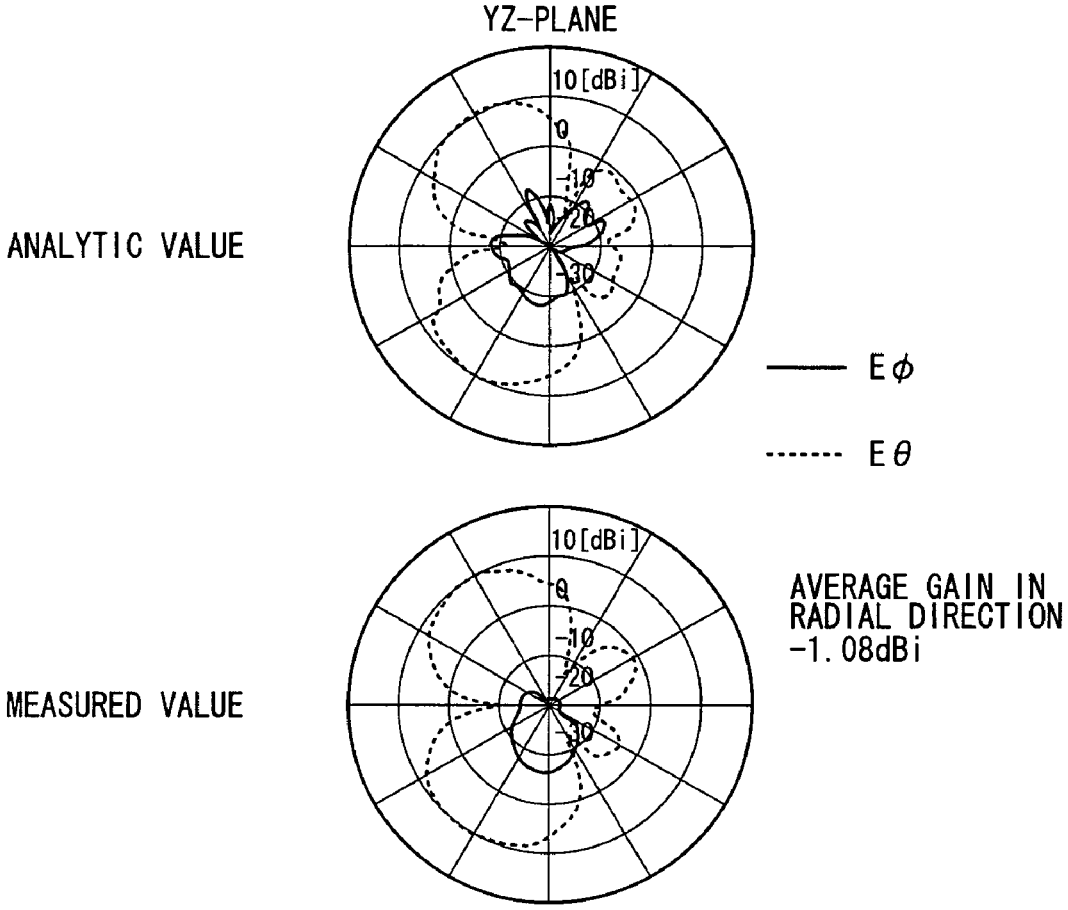
FIG. 5, consisting of FIG. 5A and FIG. 5B, is a view showing the directivity patterns of the Yagi slot antenna of the embodiment of the present invention.
Figure 5B:
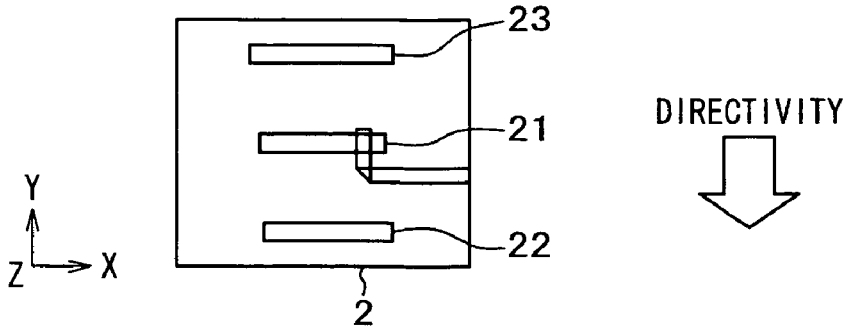

Incidentally, each of the directivity patterns shown in FIGS. 5 and 6 is also assumed to be one obtained when the planar printed circuit board 2 has thereon the director 22, the radiator 21 and the reflector 23 that are 2 mm in slot width and respectively 18 mm, 17 mm and 20.5 mm in slot length. Further, the FR-4 board formed with the glass epoxy resin having the planar size of 40 mm×40 mm, the thickness of 1 mm and the dielectric constant of 4.2 as the material is also used for the planar printed circuit board 2. Further, the directivity pattern shown in FIG. 5B is assumed to be one obtained when the length direction of the slot, the width direction of the slot and the thickness direction of the planar printed circuit board 2 are specified as the X-direction, the Y-direction and the Z-direction, respectively.

The analytic values and the measured values of the directivity patterns of the horizontal polarized wave Eϕ and the vertical polarized wave Eθ in the YZ-plane of the above Yagi slot antenna 10 are given as shown in FIG. 5A, wherein it may be also appreciated that the direction of the directivity undergoes the control by the director 22 and the reflector 23. Incidentally, the measured value of the average gain in this case is assumed to be −6.80 dBi, and the average gain in the radial direction is assumed to be −1.08 dBi.

Figure 6A:
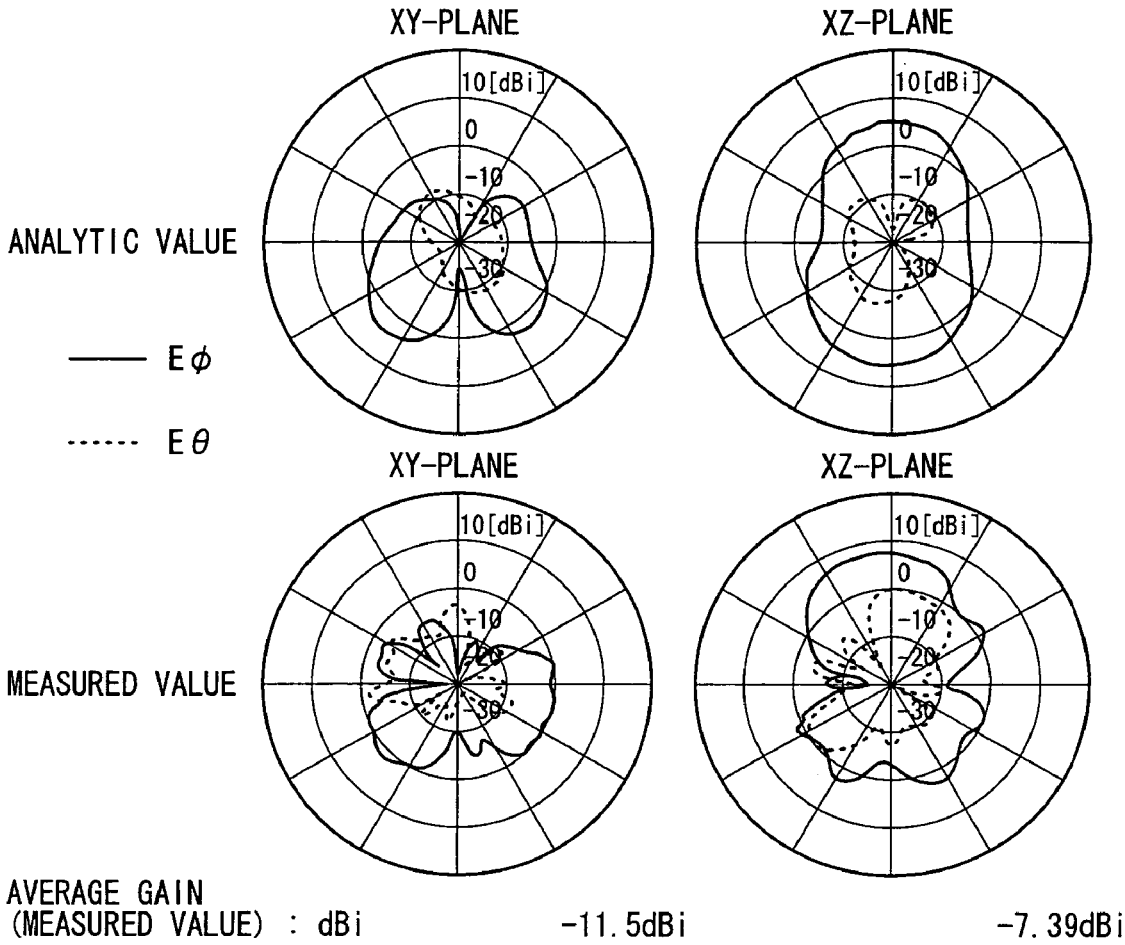
FIG. 6, consisting of FIG. 6A and FIG. 6B, is a view showing the directivity patterns of the Yagi slot antenna of the embodiment of the present invention.

For reference, the analytic values and the measured values of the directivity patterns of the horizontal polarized wave Eϕ and the vertical polarized wave Eθ in the XY-plane and the XZ-plane of the Yagi slot antenna shown in FIG. 4B are given as shown in FIG. 6A, wherein the respective average gains are assumed to be −11.5 dBi and −7.39 dBi.

Figure 6B:
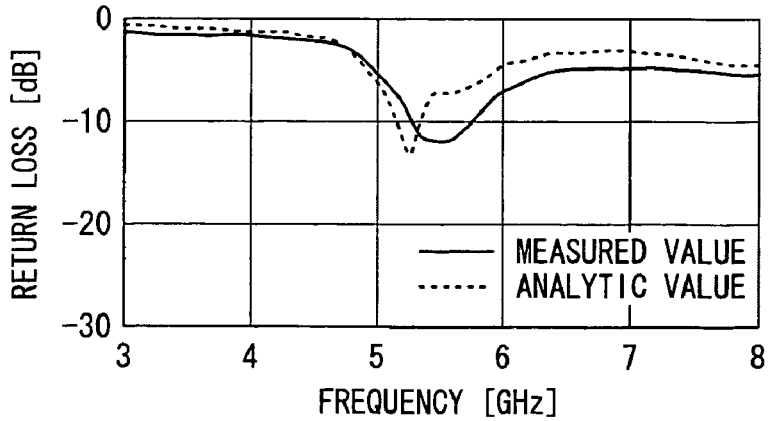

FIG. 6B is a view showing the input feature of the Yagi slot antenna 10 shown in FIG. 4B, wherein it may be also appreciated from the input feature in FIG. 6B that the Yagi slot antenna 10 causes the resonance with the length of the radiator 21 assumed to be about the ½ wavelength of the guide wavelength.

As described the above, the Yagi slot antenna 10 of the embodiment of the present invention, provided that the driven element 11 of the basic slot antenna 1 as shown in FIG. 1A (FIG. 4A) is set to function as the radiator 21, performs a change of the electrical length of either of the parasitic elements 12 and 13 to set the parasitic element 12 to function as the director 22 and the parasitic element 13 to function as the reflector 23, or on the contrary, the parasitic element 12 to function as the reflector 23 and the parasitic element 13 to function as the director 22.

Figure 7A:
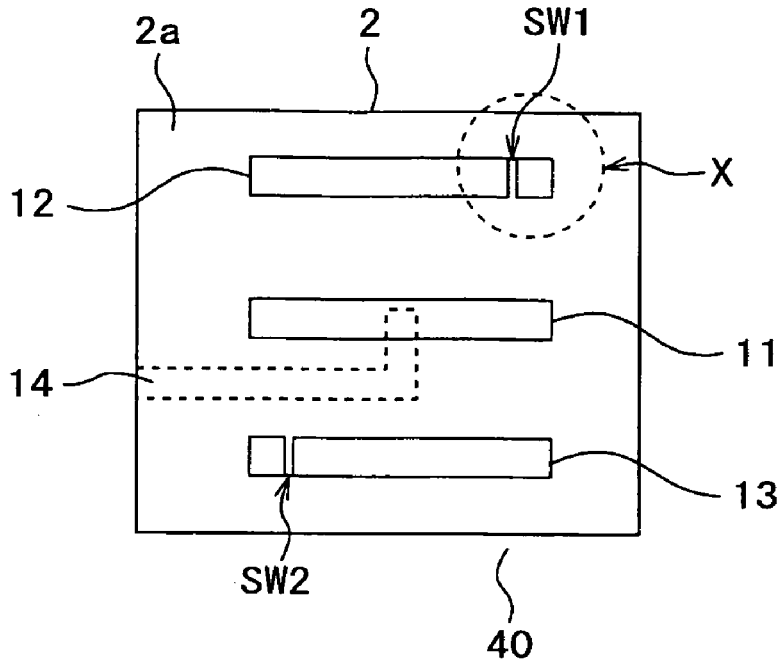
FIG. 7, consisting of FIG. 7A
FIG. 7B is a view showing a configuration of a switch provided for the Yagi slot antenna of the embodiment of the present invention.

Thus, the embodiment of the present invention is provided with switches SW1 and SW2 as changing means at prescribed positions of the parasitic elements 12 and 13 to change each electrical length of the parasitic elements 12 and 13, provided that each electrical length of the parasitic elements 12 and 13 is preliminarily set at the reflector length as shown in FIG. 7A. Then, the change of each electrical length of the parasitic elements 12 and 13 from the reflector length to the director length is performed with the switches SW1 and SW2. In this case, the switches SW1 and SW2 are supposed to be at positions where each electrical length of the parasitic elements 12 and 13 reaches the director length.

Figure 7B:
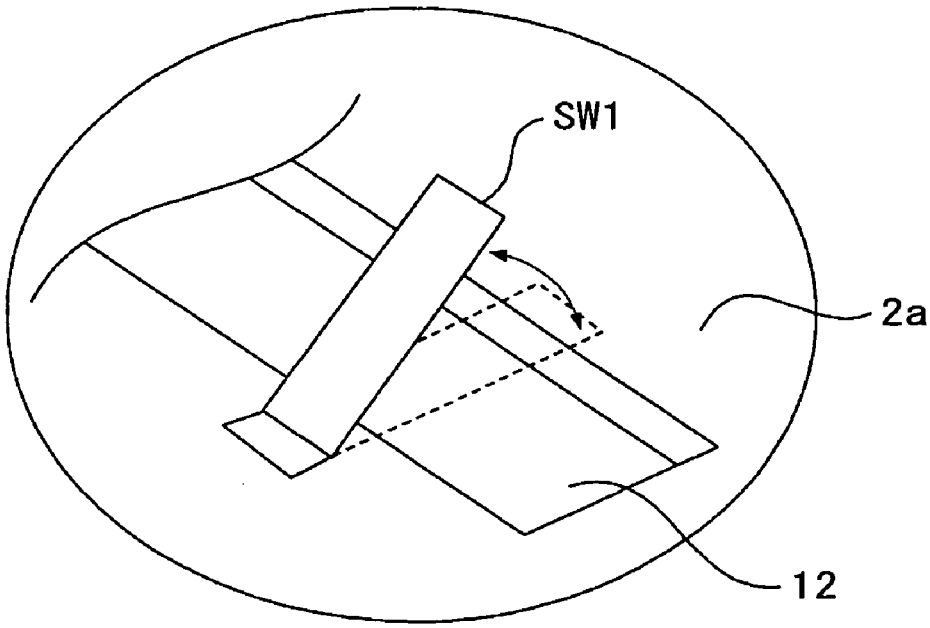

FIG. 7B is a view showing the configuration of the switch SW used for the above Yagi slot antenna 10. Incidentally, in FIG. 7B, there is shown the switch SW1 provided for the parasitic element 12. The switch SW1 shown in FIG. 7B is specified as a switch that has one end connected to the conductor 2*a* of the planar printed circuit board 2 and allows the other end to be switched over to either of an on state (a short-circuited state) making a connection to the conductor 2*a* and an off state (an open-circuited state) making no connection to the conductor 2*a*. Then, when the switch SW1 is placed in the short-circuited state, the electrical length of the parasitic element 12, for instance, may be changed from the reflector length to the director length. Incidentally, an MMIC (Monolithic Microwave IC) switch or a MEMS (Micro Electro Mechanical System) switch is supposed to be available for the switch SW1.

As described the above, the embodiment of the present invention is provided with the switches SW1 and SW2 respectively at the prescribed positions of the parasitic elements 12 and 13 to ensure that the electrical length of either of the parasitic elements 12 and 13 is changed from the reflector length to the director length by the switches SW1 and SW2.

Figure 8A:
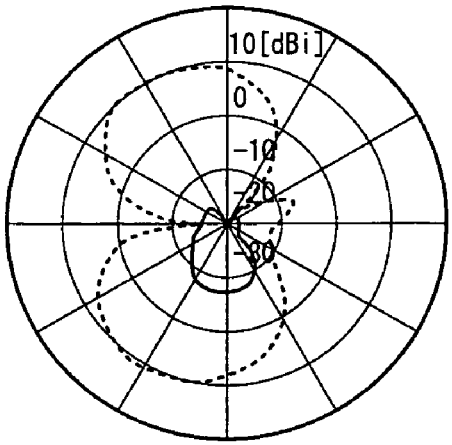
FIG. 8, consisting of FIG. 8A, 8B, and 8C, is a view showing the directivity patterns of the Yagi slot antenna shown in FIG. 7.
Figure 8B:
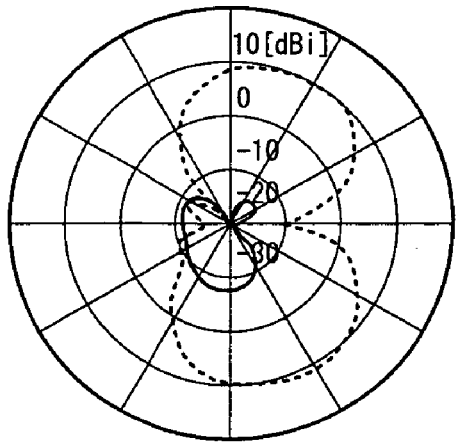
Figure 8C:
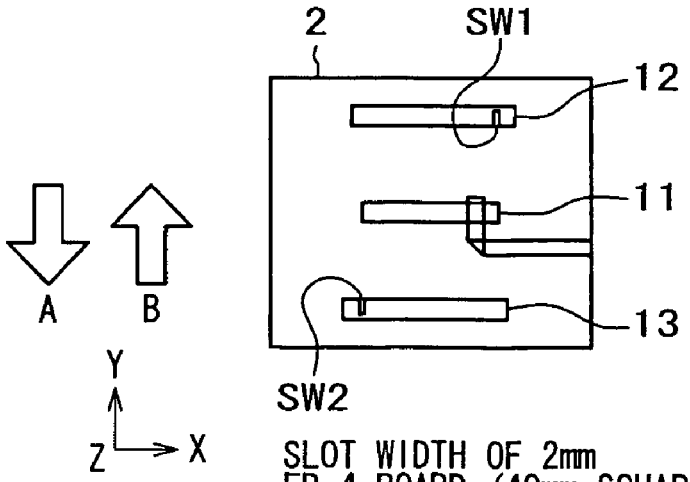

FIG. 8 is a view showing the directivity patterns of the Yagi slot antenna 10 shown in FIG. 7A. Specifically, in FIG. 8A, there is shown the directivity pattern obtained when only the switch SW2 of the parasitic element 13 is set to the on state, and in FIG. 8B, there is shown the directivity pattern obtained when only the switch SW1 of the parasitic element 12 is set to the on state. Incidentally, each of the directivity patterns in this case is also assumed to be one obtained when the planar printed circuit board 2 has thereon the parasitic element 12, the driven element 11 and the parasitic element 13 that are 2 mm in slot width and respectively 20.5 mm, 17 mm and 20.5 mm in slot length, as shown in FIG. 8C. The FR-4 board formed with the glass epoxy resin having the planar size of 40 mm×40 mm, the thickness of 1 mm and the dielectric constant of 4.2 as the material is also used for the planar printed circuit board 2. Further, each of the directivity patterns shown in FIGS. 8A and 8B is assumed to be one obtained when the length direction of the slot, the width direction of the slot and the thickness direction of the planar printed circuit board 2 are specified as the X-direction, the Y-direction and the Z-direction, respectively.

It may be appreciated from the directivity pattern of the Yagi slot antenna 10 shown in FIG. 8A that a setting of only the switch SW2 to the on state enables the directivity to be directed as shown by an arrow A in FIG. 8C. Further, it may be also appreciated that the setting of only the switch SW1 to the on state enables the directivity to be changed to a direction as shown by an arrow B in FIG. 8C. That is, it may be understood that the setting of either of the switches SW1 and SW2 to the on state enables the directivity pattern to be changed.

According to the Yagi slot antenna of the embodiment of the present invention, the parasitic elements 12 and 13 may be used in common as the director or the reflector, so that the antenna apparatus having two different directivities may be configured with the single Yagi slot antenna 10. That is, the use of the parasitic elements 12 and 13 in common as the director and the reflector makes it possible to realize the antenna apparatus being small-sized and having the two different directivities.

Figure 13:
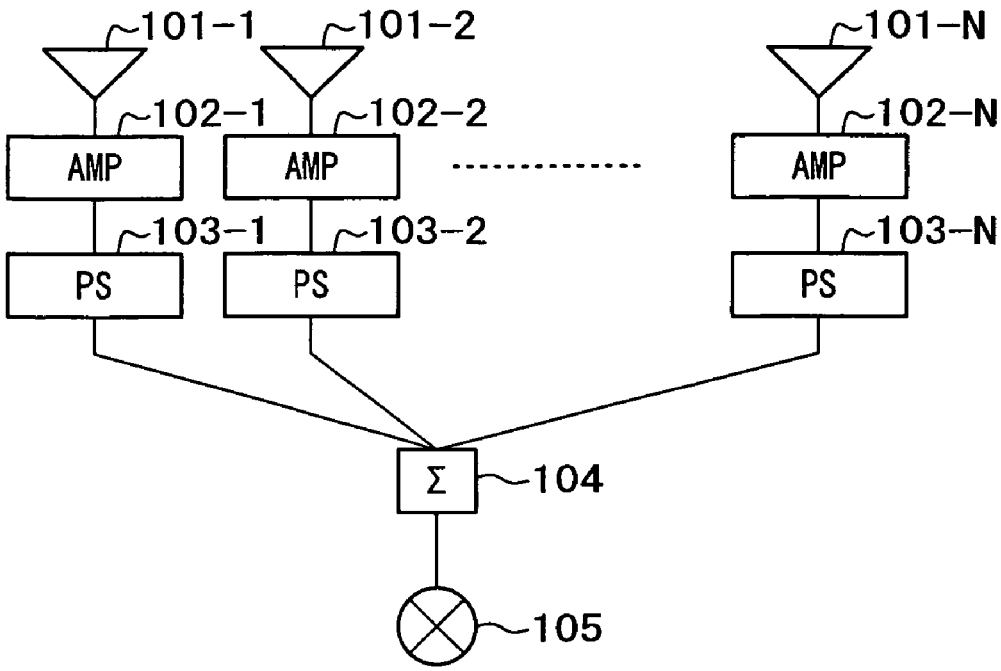
FIG. 13 is a block diagram showing the configuration of a conventional phased array antenna.
Figure 14:
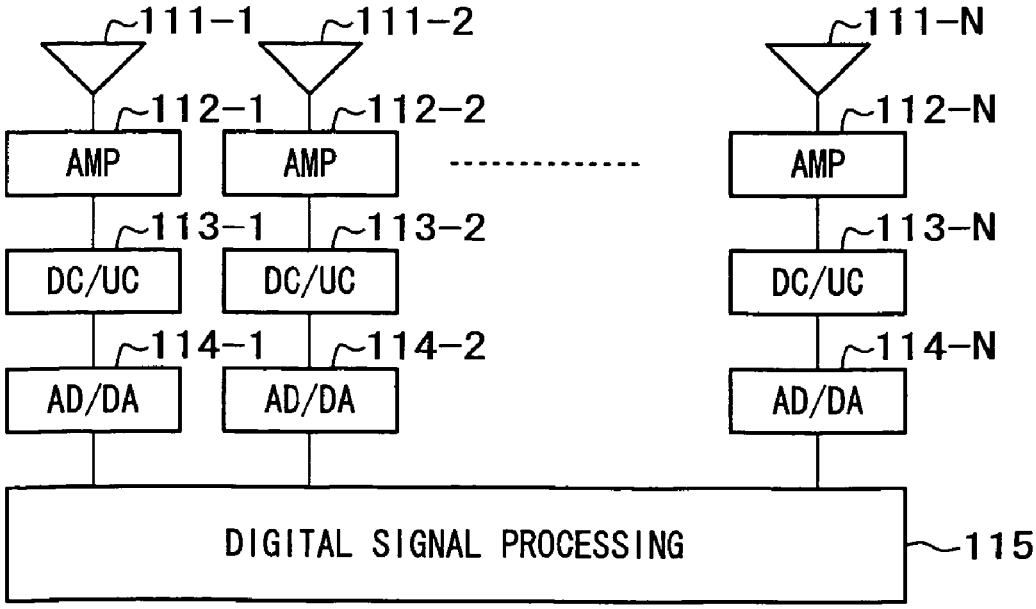
FIG. 14 is a block diagram showing the configuration of a conventional adaptive array antenna.
Figure 15A:
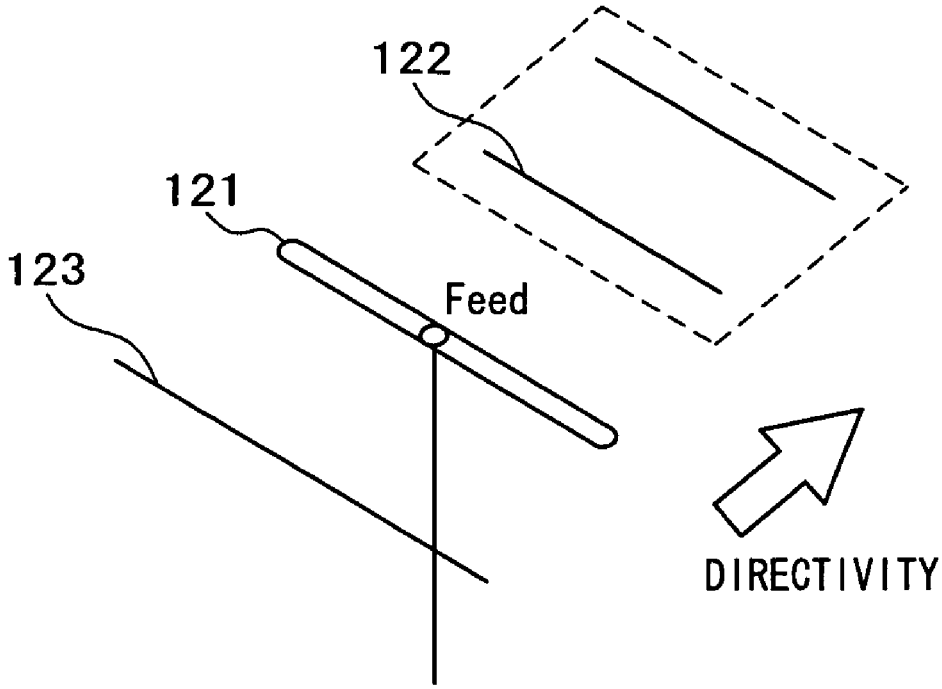
FIG. 15, consisting of FIG. 15A and FIG. 15B, is a view showing the configuration of a conventional Yagi-Uda antenna.
Figure 15B:
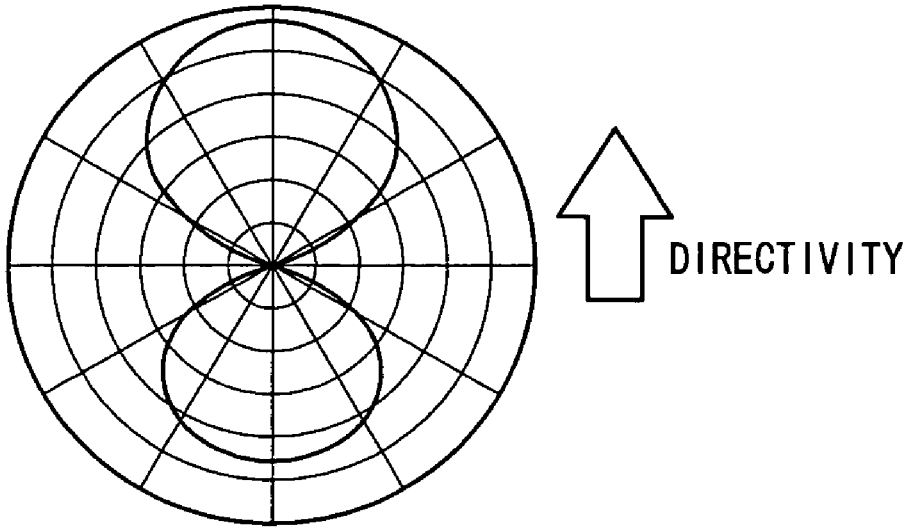

Further, the Yagi slot antenna 10 of the embodiment of the present invention eliminates the need to provide the switch SW for the driven element 11, resulting in no degradation of a radiation feature of the radiator. In addition, the Yagi slot antenna 10 of the embodiment of the present invention also eliminates the need to provide the phase shifter, unlike the conventional phased array antenna shown in FIG. 13, resulting in no degradation of the radiation feature of the radiator as well from this point of view.

Furthermore, according to the Yagi slot antenna 10 of the embodiment of the present invention, the driven element 11 operative as the radiator and the parasitic elements 12 and 13 operative as the director or the reflector may be formed directly on the conductor 2*a* of the planar printed circuit board 2, so that the antenna may reduce the thickness down to a level of a board thickness of the planar printed circuit board 2.

Moreover, the parasitic elements 12 and 13 operative as the director or the reflector are supposed to be formed on the conductor 2*a* of the planar printed circuit board 2, so that there is also an advantage of easily performing a packaging of components such as the switches SW1 and SW2 for changing each electrical length of the parasitic elements 12 and 13. In addition, the use of the dielectric substrate ensures that the effect of shortening the wavelength is obtained, resulting in an advantage of attaining a downsizing.

By the way, the Yagi slot antenna 10 having been described above is merely effective in controlling the directivity pattern on a single frequency. A multi-frequency antenna capable of controlling the directivity pattern on more than one frequency is, however, desired to meet a great variety of radio communications in recent years.

For the above reason, in the embodiment of the present invention, the above Yagi slot antenna (a first antenna circuit) and a phase-difference feed antenna (a second antenna circuit) are configured to ensure that the multi-frequency antenna capable of controlling the directivity pattern on more than one frequency is realized.

Then, a mechanism of the phase-difference feed antenna employing a hybrid coupler is now described with reference to FIG. 9, in advance of a description on the multi-frequency antenna specified as the embodiment of the present invention. A 3 dB-hybrid coupler 41 shown in FIG. 9A is in the form of a four-terminal circuit, and an S-matrix thereof may be expressed as follows.

$$[S] = \frac{1}{\sqrt{2}}\begin{bmatrix} 0 & 0 & 1 & -j \\ 0 & 0 & -j & 1 \\ 1 & -j & 0 & 0 \\ -j & 1 & 0 & 0 \end{bmatrix} \quad \text{[Expression 1]}$$

Figure 9A:
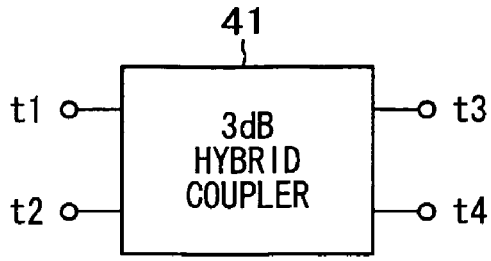
FIG. 9, consisting of FIG. 9A, FIG. 9B, FIG. 9C, and FIG. 9D, is a view showing a mechanism of a phase-difference feed antenna.

Thus, an entry of (1, 0) into input terminals t1 and t2 of the hybrid coupler 41 shown in FIG. 9A is supposed to provide a phase difference of 90 degrees between output terminals t3 and t4 at an amplitude equal to [Expression 2]

$$(1,0) \Rightarrow (1/\sqrt{2},\ -j/\sqrt{2}).$$

Further, the entry of (0, 1) into the input terminals t1 and t2 is supposed to allow the output terminals t3 and t4 to invert phases to [Expression 3]

$$(0,1) \Rightarrow (-j/\sqrt{2},\ 1/\sqrt{2}).$$

Figure 9B:
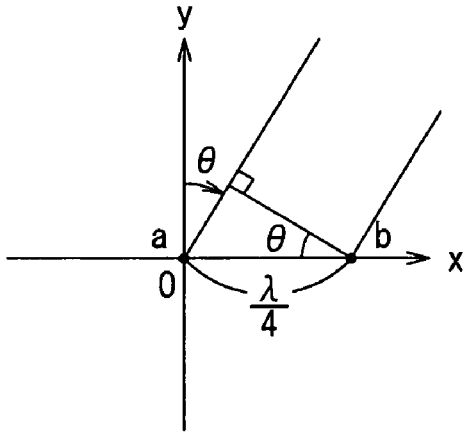

The use of a phase inversion of 90 degrees as described above enables the switching of the directivity to be performed, in which case, the phase inversion of two monopole antennas a and b spaced at an interval of ¼ λ as shown in FIG. 9B, for instance, is supposed to provide the directivity in an xy-plane as follows.

$$F(\theta) = 1 \pm je^{-j\frac{\pi}{2}\sin\theta} \quad \text{[Expression 4]}$$

Figure 9C:
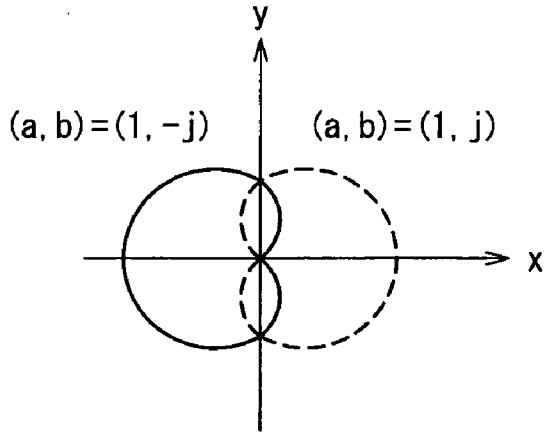

The above directivity is in the form of two Cardioid patterns symmetrical with respect to a y-axis to ensure that an inverted directivity with respect to the y-axis is obtained as shown in FIG. 9C. The phases of the monopole antennas a and b are switched over by the 3 dB-hybrid coupler 41, so that a two-way switching of the beams is made possible.

While the two-way switching is supposed to be attainable with the 3 dB-hybrid coupler 41 and a non-directional antenna, the use of the directivity of the antenna contained in an antenna array may lead to a four-way switching of beams.

Figure 9D:
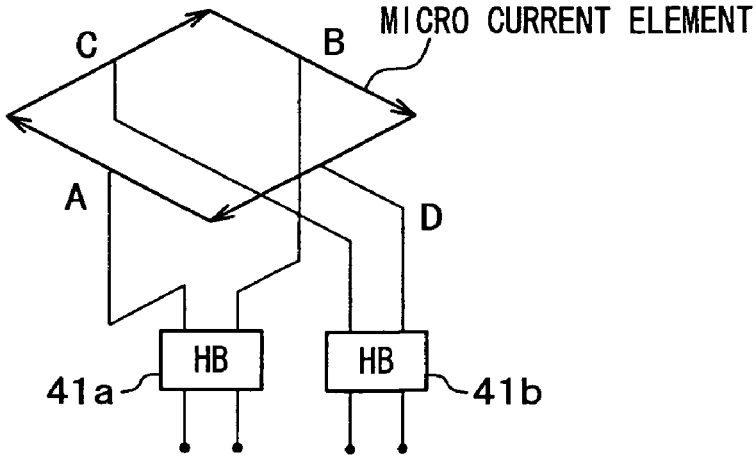

When four micro current elements each having a figure-8 pattern within a horizontal plane, for instance, are arranged as shown in FIG. 9D, an excitation of the above elements with two 3 dB-hybrid couplers 41*a* and 41*b* is supposed to enable the four-way switching of the beams to be performed within the horizontal plane.

Figure 10:
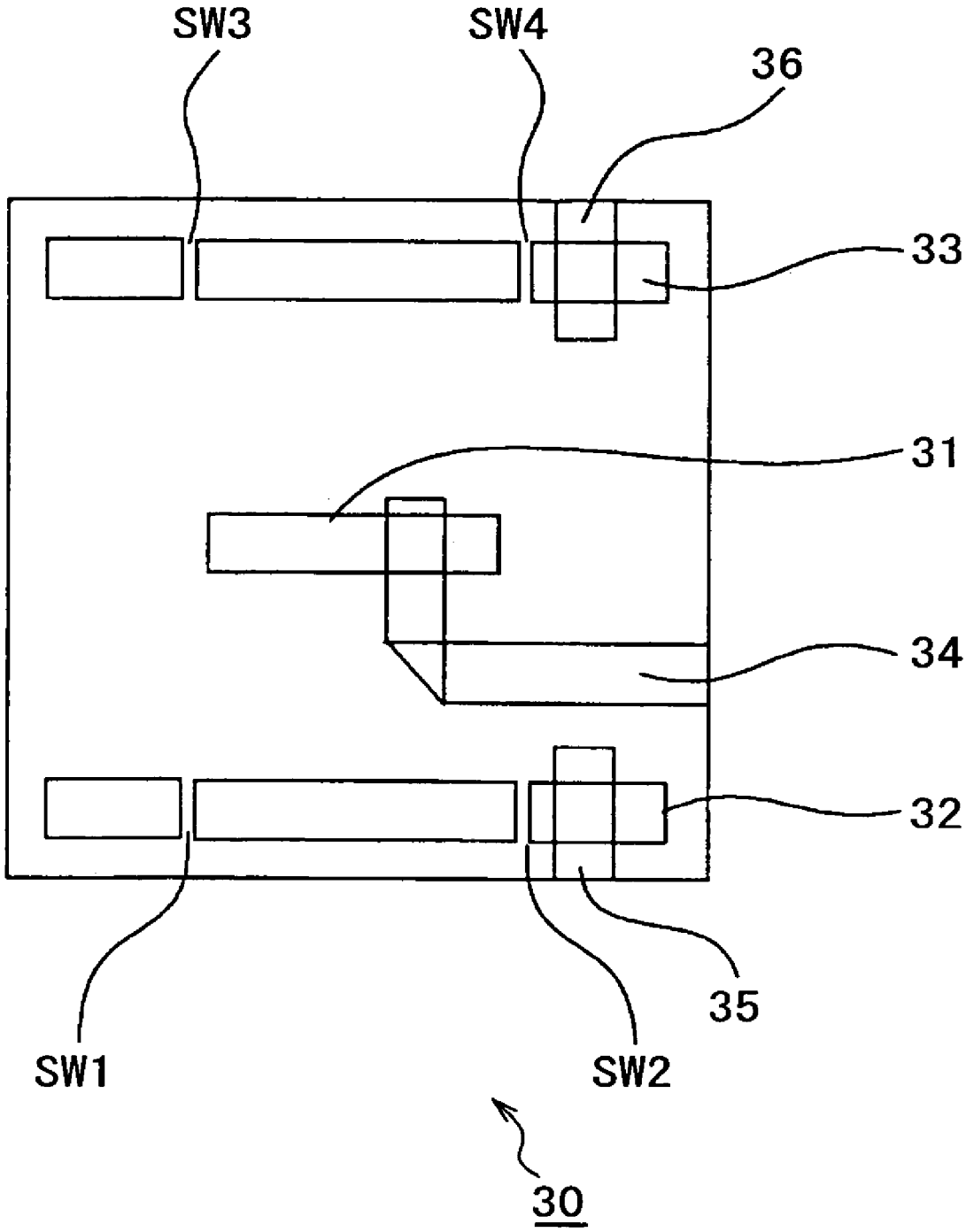
FIG. 10 is a view showing a structure of a multi-frequency antenna specified as the embodiment of the present invention.

FIG. 10 shows a structure of the multi-frequency antenna specified as the embodiment of the present invention. A multi-frequency antenna 30 of the embodiment of the present invention as shown in FIG. 10 has an antenna element 31 at the approximately center position of the planar printed circuit board 2, and antenna elements 32 and 33 before and behind the antenna element 31. The antenna element 31 is connected to a first feed unit 34 and is given the feed from the first feed unit 34. One end of the antenna element 32 is connected to a second feed unit 35 to ensure that the feed is given with the second feed unit 35. One end of the antenna element 33 is connected to a third feed unit 36 to ensure that the feed is given with the third feed unit. In this case, the slot length of the antenna element 31 is specified as the length equivalent to the ½ wavelength of the transmitting/receiving frequency. Further, each slot length of the antenna elements 32 and 33 is supposed to be larger than that of the antenna element 31.

The antenna element 32 has switches SW1 and SW2. Further, the antenna element 33 has switches SW3 and SW4. The antenna element 31 and the antenna elements 32 and 33 are spaced at intervals of about ¼ wavelength respectively.

In the multi-frequency antenna 30 of the above configuration, when setting this antenna to operate at a first frequency F1 of 5.2 GHz band, for instance, the feed from the first feed unit 34 only to the antenna element 31 is firstly performed. That is, only the antenna element 31 is set to function as the driven element (the radiator), while the antenna elements 32 and 33 are set as the parasitic elements. Then, a control of the switches SW1 and SW2 of the antenna element 32 or the switches SW3 and SW4 of the antenna element 33 is performed to control the electrical length of either of the antenna elements 32 and 33 to reach the director length. Thus, the antenna apparatus having the two-way directivity at the first frequency F1 may be realized by setting the multi-frequency antenna 30 of the embodiment of the present invention to operate like the Yagi slot antenna 10 shown in FIG. 7A.

On the contrary, when setting the multi-frequency antenna 30 of the embodiment of the present invention to operate at a second frequency F2 of 2.45 GHz band, for instance, the feed from the second feed unit 35 and the third feed unit 36 is performed at different phases (0 degree and 90 degrees), provided that the switches SW1 to SW4 are placed in the open-circuited state. With this operation, the multi-frequency antenna 30 of the embodiment of the present invention may be set to operate as the above phase-difference feed antenna for reason that the antenna elements 32 and 33 are spaced at a fixed interval, thereby providing the antenna apparatus having the two-way directivity also at the second frequency F2.

That is, according to the multi-frequency antenna 30 of the embodiment of the present invention, the control of the directivity pattern of the radio waves at two different frequency bands of the first frequency F1 and the second frequency F2 may be ensured.

Further, in this case, the antenna elements 32 and 33 may be used in common as the parasitic element in the Yagi slot antenna and a radiation element in the phase-difference feed antenna, so that there is also an advantage of attaining the downsizing of the multi-frequency antenna.

FIG. 11 shows the directivity patterns of the multi-frequency antenna of the embodiment of the present invention shown in FIG. 10. It may be appreciated that when using the multi-frequency antenna 30 at the first frequency F1, the directivity of the multi-frequency antenna is made controllable by setting the switches SW1 and SW2 of the antenna element 32 to a short-circuited position (the short-circuited state) and the switches SW3 and SW4 of the antenna element 33 to an opened position (the open-circuited state) or by changing over the switches SW1 and SW2 of the antenna element 32 to the opened position (the open-circuited state) and the switches SW3 and SW4 of the antenna element 33 to the short-circuited position (the short-circuited state), as shown in FIGS. 11A and 11B.

It may be also appreciated that when using the multi-frequency antenna 30 of the embodiment of the present invention at the second frequency F2, the directivity pattern of the multi-frequency antenna is made controllable by performing the feed, with the second feed unit 35 set to have the phase of 90 degrees and the third feed unit 36 set to have the phase of 0 degree or on the contrary, with the second feed unit 35 set to have the phase of 0 degree and the third feed unit 36 set to have the phase of 90 degrees, as shown in FIGS. 11C and 11D.

Figure 12A:
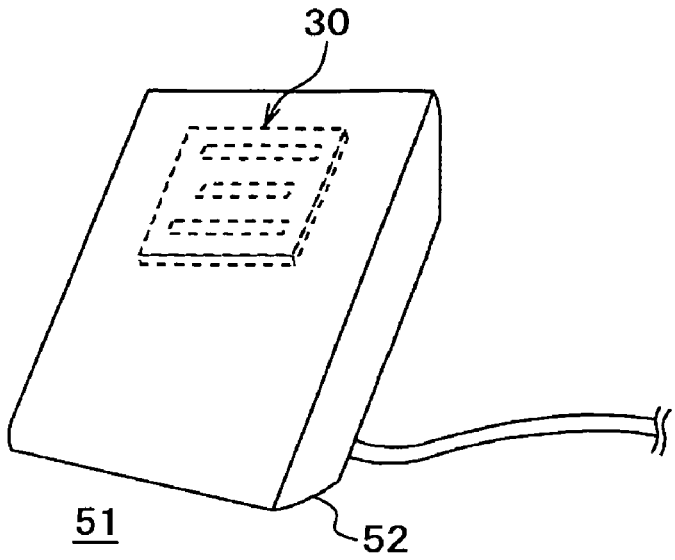
FIG. 12, consisting of FIG. 12A and FIG. 12B, is a view showing an electronic apparatus mounted with the Yagi slot antenna of the embodiment of the present invention.
Figure 12B:
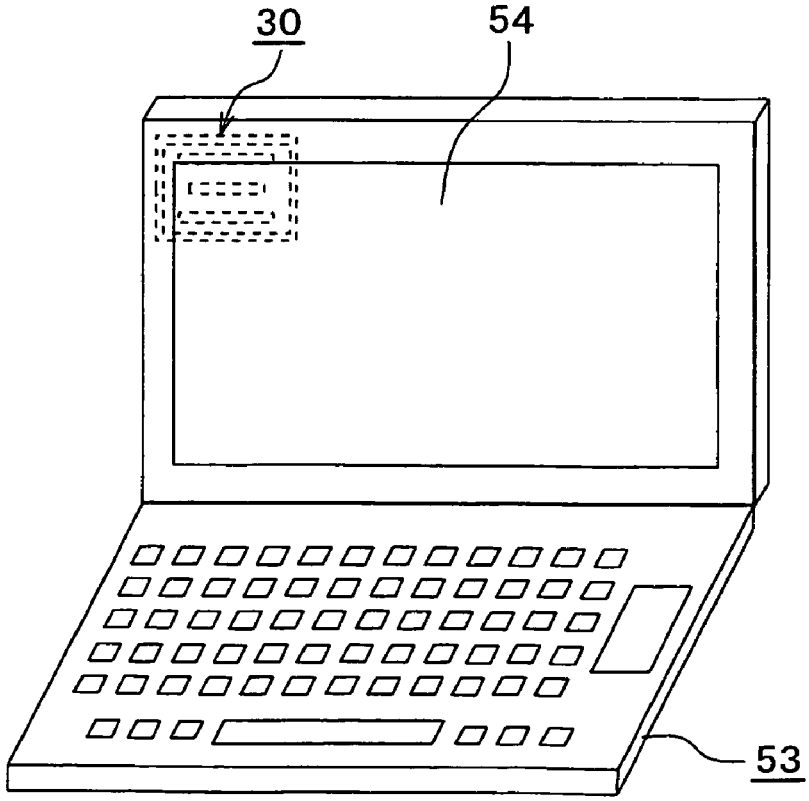

Thus, a mounting of the multi-frequency antenna 30 of the embodiment of the present invention in an apparatus body 52 of a wireless LAN base station apparatus 51 available at any place irrespective of indoor and outdoor places as shown in FIG. 12A, in a mobile information terminal 53 such as a notebook-sized personal computer as shown in FIG. 12B or in a non-illustrated wireless television receiver makes it possible to realize the multi-frequency antenna adaptive to more than one radio communication. Further, the multi-frequency antenna in this case enables the control of the directivity, leading to a possibility of restraining the degradation of the communication quality with the interference wave caused by the reflection from the wall etc.

Further, while the multi-frequency antenna 30 of the embodiment of the present invention limits the number of the antenna elements 32 and 33 available also as the director or the reflector to one, respectively, this is merely given as one instance, and it is also allowable to form each of the antenna elements 32 and 33 with more than one antenna element. Furthermore, while the embodiment of the present invention has been described by taking the case of the antenna configured on the basis of the slot antenna, it is a matter of course that the above antenna may be also configured on the basis of antennas other than the slot antenna.

What is claimed is:

1. An antenna apparatus, comprising:

a first antenna element having a prescribed electrical length;

first feed means for providing a first RF signal feed to said first antenna element;

second and third antenna elements respectively having an electrical length larger than the prescribed electrical length of said first antenna element and disposed at opposite sides of said first antenna element, said second and third antenna elements being configurable as driven elements when being fed RF signals;

second feed means configurable for providing a second RF signal feed to said second antenna element;

third feed means configurable for providing a third RF signal feed to said third antenna element, wherein said second and third RF signals have a different phase and are simultaneously fed to said second and third antenna elements; and changing means for respectively changing the electrical lengths of said second and third antenna elements.

2. The antenna apparatus according to claim 1, wherein said antenna apparatus is capable of forming:

a first antenna circuit by performing the feed from said first feed means to said first antenna element and by changing, by said changing means, the electrical length of at least one of said second antenna element and said third antenna element disposed at the opposite sides of said first antenna element, and a second antenna circuit by performing the feed respectively at the different phases from said second and third feed means to said second and third antenna elements disposed at the opposite sides of said first antenna element.

3. The antenna apparatus according to claim 1, wherein said first antenna element, said second antenna element, and said third antenna elements are respectively configured by forming a slot on a conductor.

* * * * *